US006254380B1

(12) United States Patent
Henderson et al.

(10) Patent No.: US 6,254,380 B1
(45) Date of Patent: Jul. 3, 2001

(54) DEVICE FOR PREVENTING FLAREUP IN BAROMETRIC-TYPE LIQUID FUEL BURNERS BY PREVENTING EXCESSIVE TEMPERATURE LEVELS AT REMOVABLE FUEL TANK

(76) Inventors: Richard W. Henderson, P.O. Box 12368, Florence, SC (US) 29504; Harry H. Henderson, 152 Adron Woodard Rd., De Ridder, LA (US) 70634

( * ) Notice: Subject to any disclaimer, the term of this patent is extended or adjusted under 35 U.S.C. 154(b) by 0 days.

(21) Appl. No.: 09/583,199

(22) Filed: May 30, 2000

(51) Int. Cl.[7] ..... F23N 5/02

(52) U.S. Cl. ..... 431/21; 431/33; 431/319; 126/96; 126/287.5

(58) Field of Search ..... 126/96, 95, 45, 126/92 R, 92 AC, 287.5; 431/75, 78, 304–307, 2, 21, 201, 195, 12, 13, 18, 33, 319

(56) References Cited

U.S. PATENT DOCUMENTS

| | | | | |
|---|---|---|---|---|
| 1,392,187 | | 9/1921 | Mahan | 137/405 |
| 1,623,161 | | 4/1927 | Buerger | 137/405 |
| 1,706,704 | | 3/1929 | Phillips | 137/405 |
| 1,725,538 | | 8/1929 | Remnsnider | 137/405 |
| 2,151,001 | * | 3/1939 | Andersson | 431/21 |
| 2,165,162 | | 7/1939 | Thornton | 431/117 |
| 2,195,264 | * | 3/1940 | Simpson | 431/21 |
| 3,169,519 | | 2/1965 | Aizawa . | |
| 3,501,252 | | 3/1970 | Richardson . | |
| 4,363,620 | | 12/1982 | Nakamura . | |
| 4,664,095 | | 5/1987 | Takahashi . | |
| 4,797,088 | | 1/1989 | Nakamura . | |
| 4,872,831 | | 10/1989 | Fujimoto . | |
| 5,080,578 | | 1/1992 | Josephs . | |
| 5,165,883 | | 11/1992 | Van Bemmel . | |
| 5,338,185 | | 8/1994 | Henderson et al. | 431/33 |
| 5,409,370 | | 4/1995 | Henderson | 431/2 |
| 5,456,595 | | 10/1995 | Henderson | 431/2 |
| 5,549,470 | | 8/1996 | Henderson | 431/302 |
| 5,551,865 | | 9/1996 | Henderson et al. | 431/33 |
| 5,662,468 | | 9/1997 | Henderson | 431/302 |

(List continued on next page.)

FOREIGN PATENT DOCUMENTS

| | | | |
|---|---|---|---|
| 572552 | 11/1958 | (BE) | 126/96 |
| 1205018 | 9/1970 | (GB) . | |

OTHER PUBLICATIONS

Richard W. Henderson and George R. Lightsey, "Kerosene Heater Fires: Barometric Type," *Fire Marshals Bulletin* (87–5),pp. 8–10, Nov. 1987.

Richard W. Henderson and George R. Lightsey, "Kerosene Heater Fires: Barometric Type," *The National Fire and Arson Report*, vol. 6(1), pp. 2–4 (1988).

Richard W. Henderson, "Barometric Kerosene Heaters," *Fire and Arson Investigator* vol. 39(3), pp. 26–27 (1989).

(List continued on next page.)

*Primary Examiner*—James C. Yeung
(74) *Attorney, Agent, or Firm*—David Pressman

(57) ABSTRACT

A safety device for preventing uncontrolled burning in barometric-type liquid fuel burners of the type where a removable fuel tank (60) feeds a fuel chamber (40), which supplies the fuel to a wick (54), via a sump opening in the upper surface of the chamber (40). A fusible link (28), which is affixed to a tank guide (12) via a support (30), is connected to an arm (74). The arm (74) is in turn connected to a lever (78) in a hinged fashion. The lever (78) is attached to a support (82) in a hinged fashion. A face (80) is present on the lever (78) at the end of the lever (78) distal to the end connected to arm (74). The face (80) is proximate to an automatic wick extinguishing unit (42). Should the temperature of fusible link (28) exceed a predetermined level, it will open irreversibly, allowing arm (74) to move downward, which in turn causes lever (78) to rotate about support (82), forcing face (80) upward, which actuates the automatic wick extinguishing unit (42).

10 Claims, 2 Drawing Sheets

U.S. PATENT DOCUMENTS

| | | | |
|---|---|---|---|
| 5,730,115 | 3/1998 | Henderson | 126/96 |
| 5,772,425 | 6/1998 | Henderson | 431/319 |
| 5,899,682 | 5/1999 | Henderson et al. | 431/12 |
| 5,967,765 | 10/1999 | Henderson et al. | 431/12 |

OTHER PUBLICATIONS

John J. Lentini, "Gasoline and Kerosene Don't Mix—At Least, Not in Kerosene Heaters," *Fire Journal*, vol. 83(4), pp. 13,86 (1989) (Jul.–Aug.).

Richard W. Henderson and George R. Lightsey, "An Anti–Flareup Device for Barometric Kerosene Heaters," *Fire and Arson Investigator*, vol. 45(2), 8(1994).

Richard W. Henderson, "Barometric Kerosene Heaters; An Overview of Failure Modes and Solutions," *Fire and Arson Investigator*, vol. 464, 13(1996).

* cited by examiner

DEVICE FOR PREVENTING FLAREUP IN BAROMETRIC-TYPE LIQUID FUEL BURNERS BY PREVENTING EXCESSIVE TEMPERATURE LEVELS AT REMOVABLE FUEL TANK

BACKGROUND—CROSS-REFERENCE TO RELATED APPLICATIONS

This invention is an improvement over the inventions of several earlier applications, to-wit:

Ser. No. 08/130,290, filed Oct. 4, 1993 now U.S. Pat. No. 5,338,185, granted Aug. 16, 1994 in the names of Richard W. Henderson and George R. Lightsey;

Ser. No. 08/247,925, filed May 23, 1994 now U.S. Pat. No. 5,456,595, granted Oct. 10, 1995 in the name of Richard W. Henderson;

Ser. No. 08/297,048, filed Sept. 30, 1994 now U.S. Pat. No. 5,409,370, granted Apr. 25, 1995 in the name of Richard W. Henderson;

Ser. No. 08/365,804, filed Dec. 29, 1994 now U.S. Pat. No. 5,549,470, granted Aug. 27, 1996 in the name of Richard W. Henderson;

Ser. No. 08/514,583, filed Aug. 14, 1995 now U.S. Pat. No. 5,662,468, granted Sep. 2, 1997 in the name of Richard W. Henderson.

Ser. No. 08/559,922, filed Nov. 17, 1995 now U.S. Pat. No. 5,551,865, granted Sep. 3, 1996 in the names of Richard W. Henderson and Samuel R. Henderson;

Ser. No. 08/684,131, filed Jul. 19, 1996 now U.S. Pat. No. 5,730,115, granted Mar. 24, 1998 in the name of Richard W. Henderson;

Ser. No. 08/684,132, filed Jul. 19, 1996 now U.S. Pat. No. 5,772,425, granted Jun. 30, 1998 in the name of Richard W. Henderson;

Ser. No. 08/829,037, filed Mar. 31, 1997 now U.S. Pat. No. 5,899,682, granted May 4, 1999 in the names of Richard W. Henderson and Kerryl L. Henderson; and Ser. No. 08/916,764, filed Aug. 19, 1997 now U.S. Pat. No. 5,551,865, granted Oct. 19, 1999 in the names of Richard W. Henderson and E. Randolph Lucas.

BACKGROUND—FIELD OF INVENTION

This invention relates to safety devices, specifically to a mechanism for prevention of flareup in barometric-type wick-fed liquid fuel burners.

BACKGROUND—DISCUSSION OF PRIOR ART

Wick-fed liquid fuel burners, such as kerosene heaters, are used for space or area heating in homes, businesses, cabins, manufactured housing, and the like. In such burners liquid fuel from a fuel chamber is supplied to a wick which is exposed to the oxygen of the atmosphere within a wick-receiving combustion chamber. Once the wick has been ignited, flame intensity and heat generation are controlled by adjusting the length of the exposed wick.

A common type of kerosene heater is the barometric style, in which gravity causes liquid fuel to be delivered to a horizontal fuel chamber from a vertically-oriented, removable fuel tank inserted into a mating well, or sump, in a top surface of the fuel chamber. In some cases a sight gauge is mounted on the side of the removable tank to monitor the fuel level in that tank when the tank is filled, and during operation of the burner. The flow of fuel from the removable tank into the fuel chamber is governed by a barometric, or fuel release, valve in the cap on the removable tank, which, in normal operation, maintains the level of the fuel in the fuel chamber at the level of the barometric valve. A partial vacuum above the fuel in the removable tank prevents the fuel from flowing into the fuel chamber until the fuel level in the fuel chamber drops below the barometric valve, which then allows air to enter the removable tank. As air enters the removable tank through the barometric valve, fuel in the removable tank flows into the fuel chamber until its level in the fuel chamber rises and covers the barometric valve, causing fuel flow from the removable tank to cease.

The barometric valve consists of a spring-loaded plunger, which has an enlarged head at one end. When the removable tank is inserted into the fuel chamber, the plunger head contacts a pin located in the fuel chamber, which pushes the plunger back, allowing the fuel in the removable tank to be in fluid communication with the fuel chamber.

When the tank is removed, the action of the spring on the plunger head forces it against the opening in the tank cap, sealing the opening and preventing fuel from leaving the tank. The capacity of the removable tank is typically about four to five liters (four to five quarts), while the fuel chamber can hold a maximum of about two liters (two quarts).

Various improvements have been made to such burners which make them safer to operate. For example, tip-over shut-off mechanisms, manual shut-off devices, and low-level $O_2$ detectors have been employed. However, these burners continue to cause fires that result in death, injury, and property loss. These fires are caused, because, under certain conditions, vapors from the sump area can be ignited by the wick flame, and in other cases, fuel can overflow the fuel chamber. When the overflowing fuel ignites, the result is an uncontrollable fire outside the heater cabinet, or flareup.

There are safety devices that drop the wick down, thereby extinguishing the flame, if the burner tips over or experiences excessive vibration, or if abnormal combustion is detected. Other safety devices detect high levels of $CO_2$ and low levels of $O_2$ in the vicinity of the heater, and use these to control burning rates. Still others regulate the position of the wick during the ignition and extinguishing operations of the heater to prevent excessive flaming during these operations. Examples are shown in U.S. Pat. No. 4,363,620, issued Dec. 14, 1982 to Nakamura; U.S. Pat. No. 4,872,831, issued Oct. 10, 1989 to Fujimoto; U.S. Pat. No. 4,797,088, issued Jan. 10, 1989 to Nakamura; U.S. Pat. No. 4,805,589, issued Feb. 21, 1989 to Nakanishi; and U.S. Pat. No. 5,165,883, issued Nov. 24, 1992 to Van Bemmel. However, not only do these devices fail to prevent flareup, they are ineffective in stopping flareup after its onset. In some cases, the safety devices require the use of electrical power and electronic circuitry for actuation: this increases the cost of the burners significantly, without rectifying the flareup problem.

It has been suggested in two publications ("Kerosene Heater Fires: Barometric Type," R. Henderson et al., *Fire Marshals Bulletin* (National Fire Protection Association), Vol. 87-5, p. 8 (1987); and "Barometric Kerosene Heaters," R. Henderson, *Fire and Arson Investigator* (International Association of Arson Investigators), Vol. 39, No. 3, p. 26 (1989)) to make the size of the removable tank of barometric kerosene heaters comparable in volume to that of the fuel chamber so that flooding of the fuel chamber will not occur. To implement this suggestion, either the capacity of the removable tank must be reduced, or alternatively, that of the fuel chamber must be increased. However, reducing the capacity of the removable tank will reduce the burn time accordingly, and possibly affect the marketability of the heaters. Increasing the capacity of the fuel chamber will require that new tanks be designed and implemented.

Also, it has been suggested that a float device be introduced into the fuel chamber to be used to activate the automatic wick extinguishing mechanism, and a sight gauge be present to show dangerous fuel levels in the fuel chamber. Introduction of such a float device would also require that the fuel chamber be redesigned, as discussed above. Although some burners have sight gauges in the fuel chamber, the sight gauges are used only to indicate whether or not fuel is present, not when dangerous fuel levels are present in the fuel chamber.

In addition it was proposed that a tank block-out device be installed. In this, a float in the fuel chamber pushes a pin that moves if the removable tank is withdrawn from the heater. Once again, such a device would require a redesigning of the fuel chamber and insertion of moving parts inside a somewhat restricted space.

U.S. Pat. No. 4,797,088, issued Jan. 10, 1989 to Nakamura, claims that its device detects an excessively increased flame—which most often is due to the presence of a highly volatile fuel in the burner—and actuates an automatic wick extinguishing mechanism. However, this device has a significant disadvantage in that it re-sets after the burner cools down, which allows the burner to be re-ignited, with the dangerous fuel still inside the burner. Also, the device requires electrical circuitry for some of its operation.

U.S. Pat. 5,080,578, issued Jan. 14, 1992 to Josephs, claims that its device controls flareup in wick-fed liquid fuel burners by a) cutting off the flow of fuel to the wick in response to excessive heat by blocking a fuel line, and b) withdrawing the wick into the wick chamber when sensing excessive heat. However, Josephs' device has several disadvantages:

a) Excessive heat must be generated near the sensors before the flow of fuel is interrupted, or the wick is withdrawn. Therefore, since flareup is not prevented, the device only limits the spread of undesired flames after flareup has already begun.

b) Heat-sensing devices must be near the area where uncontrolled burning is taking place due to overflow of fuel. But often the path that the overflowing fuel takes is random and flareup may not initially occur near the heat sensors.

c) The device is not applicable to barometric liquid fuel burners—one of the most common wick-fed liquid fuel burners in use—because these burners do not have fuel lines.

d) From the onset of flareup in wick-fed liquid fuel burners, fire is present outside the wick; therefore, retracting the wick does not affect the flareup process.

The device of the above U.S. Pat. No. 5,338,185 of Henderson and Lightsey consists, in part, of an excess fuel containment compartment below the level of the fuel chamber. It prevents flareup by activating a wick-extinguishing mechanism when the presence of excess fuel is detected in the fuel chamber. While this device has much merit, to be effective it requires activation of a second mechanism, that is, an automatic wick extinguisher.

The device of the above U.S. Pat. No. 5,456,595 of Henderson prevents flareup by lifting the removable tank when excess fuel is present in the fuel chamber, thereby shutting off the barometric valve and stopping fuel flow from the removable tank. For this device to work, a spring must be provided to lift the removable tank and its contents (liquid fuel), the total weight of which can be up to some five kilograms (ten pounds). Accordingly, should the spring lose strength, or should the removable tank become hindered in its upward movement, this device may not be able to prevent flareup in some situations.

The device of the above U.S. Pat. No. 5,409,370 of Henderson prevents flareup by dropping the pin which holds open the barometric valve in the removable tank cap, thereby closing the valve and stopping fuel flow into the fuel chamber. Should the valve not close properly, this device may not prevent flareup in some situations.

The device of the above U.S. Pat. No. 5,549,470 of Henderson prevents flareup by providing a thermal barrier between the combustion cylinder and the removable tank, which helps lower the temperature of the removable tank so that fuel vapor pressures do not become excessive. In addition, it includes a warning gauge that alerts the user to the dangerous condition of the burner when excess fuel is present in the fuel chamber. It also provides an excess fuel containment system that can hold the entire contents of the removable tank should all the fuel be released rapidly.

This system consists, in part, of a fuel containment sump, which extends upward from the top of the fuel chamber, and which surrounds the removable tank, but which does not have a closure at its top. This device has much merit in that it is effective without involving any moving parts for its operation. However, the additional components add to the weight of the burner.

The device of the above U.S. Pat. No. 5,662,468 of Henderson prevents flareup by containing fumes in the vicinity of the removable tank and by providing (a) a closure at the top of the compartment housing the removable tank, and (b) a block-out mechanism for the removable tank should excess fuel be present in the fuel chamber. Although this device also has much merit, it requires the introduction of a tank block-out mechanism in the sump in a somewhat restricted space.

The device of the above U.S. Pat. No. 5,730,115 of Henderson acts to prevent flareup by providing a float in the fuel chamber, which float rises in response to the presence of excess fuel in the fuel chamber. As the float rises, it moves a member which obturates an opening from the sump to the chamber, causing the opening into the fuel chamber to be closed. If the opening does not seal properly, excess fuel will continue to flow into the chamber, which may result in flareup.

The device of the above U.S. Pat. No. 5,772,425 of Henderson prevents flareup by containing vapors in the sump area when the removable fuel tank is inserted into the fuel chamber. A gasket contains vapors present in the sump area when the tank is seated in the sump opening. When the tank is removed from the sump opening, a plate moves upward due to the action of a spring and contains vapors in the sump area. While this device is quite effective in preventing flareup due to vapor migration from the sump area, it may not prevent flareup should excess fuel enter the fuel chamber, causing an overflow of fuel from the fuel chamber.

The device of the above U.S. Pat. No. 5,899,682 of Henderson and Henderson prevents flareup by regulating the rate at which fuel can flow out of the removable tank into the fuel chamber. It consists of a compartment inside the removable tank such that fuel is contained inside that compartment when the tank is inserted into the heater cabinet. Fuel leaving the compartment must travel through a restrictor, which regulates fuel flow out of the removable tank. While this system does control the rate at which fuel leaves the removable tank, the rate is not constant. When the fuel is at its greatest depth, the flow rate will be at its maximum. As the level drops, the flow rate decreases in a square root fashion; for example, when the depth decreases to one-fourth of what it was originally, the flow rate will decrease to one-half of its original value.

The device of the above U.S. Pat. No. 5,551,865 of Henderson and Henderson employs a thermocouple/solenoid/lever system, which lever must be engaged until the wick flame is established sufficiently such that the solenoid can maintain the position of the lever so that it does not actuate the automatic wick extinguishing mechanism. Should excess fuel enter the fuel chamber, a float causes the thermocouple/solenoid circuit to open, which releases the lever, actuating the wick extinguishing mechanism. This device has the advantage in that it self-tests the system each time the burner is operated. On the other hand, the device requires electrical circuitry and components for its operation.

The device of the above U.S. Pat. No. 4,797,088 of Nakamura acts to detect an excessively-increased flame, and actuate a wick extinguishing mechanism. However, the device re-sets after the burner cools down, allowing the burner to be re-lit while the dangerous fuel is still inside the burner. In addition, electrical circuitry is required for its operation.

OBJECTS AND ADVANTAGES

Accordingly, several objects and advantages of the present invention are to provide an improved and safer wick-fed, barometric, liquid fuel burner, to provide such a burner with a safety device which does not require the reduction in capacity of the removable fuel tank, does not require the redesigning of the fuel chamber to increase its capacity, does not require electrical power or electronic circuitry, is applicable to kerosene heaters that do not have fuel lines, and acts to extinguish the wick flame irreversibly should the temperature reach excessive levels at the removable tank, thereby preventing flareup from the flooding fuel.

In addition, the present device is quite simple in design and inexpensive to incorporate, does not have any substantially increased weight, will save lives and property, will make barometric liquid fuel burners easier to market because of added safety value, and will likely reduce the number of expensive lawsuits prompted by injury, loss of life, and property damage.

Still further objects and advantages will become apparent from a consideration of the ensuing description and drawings.

DRAWING REFERENCE NUMERALS

Figure 1:
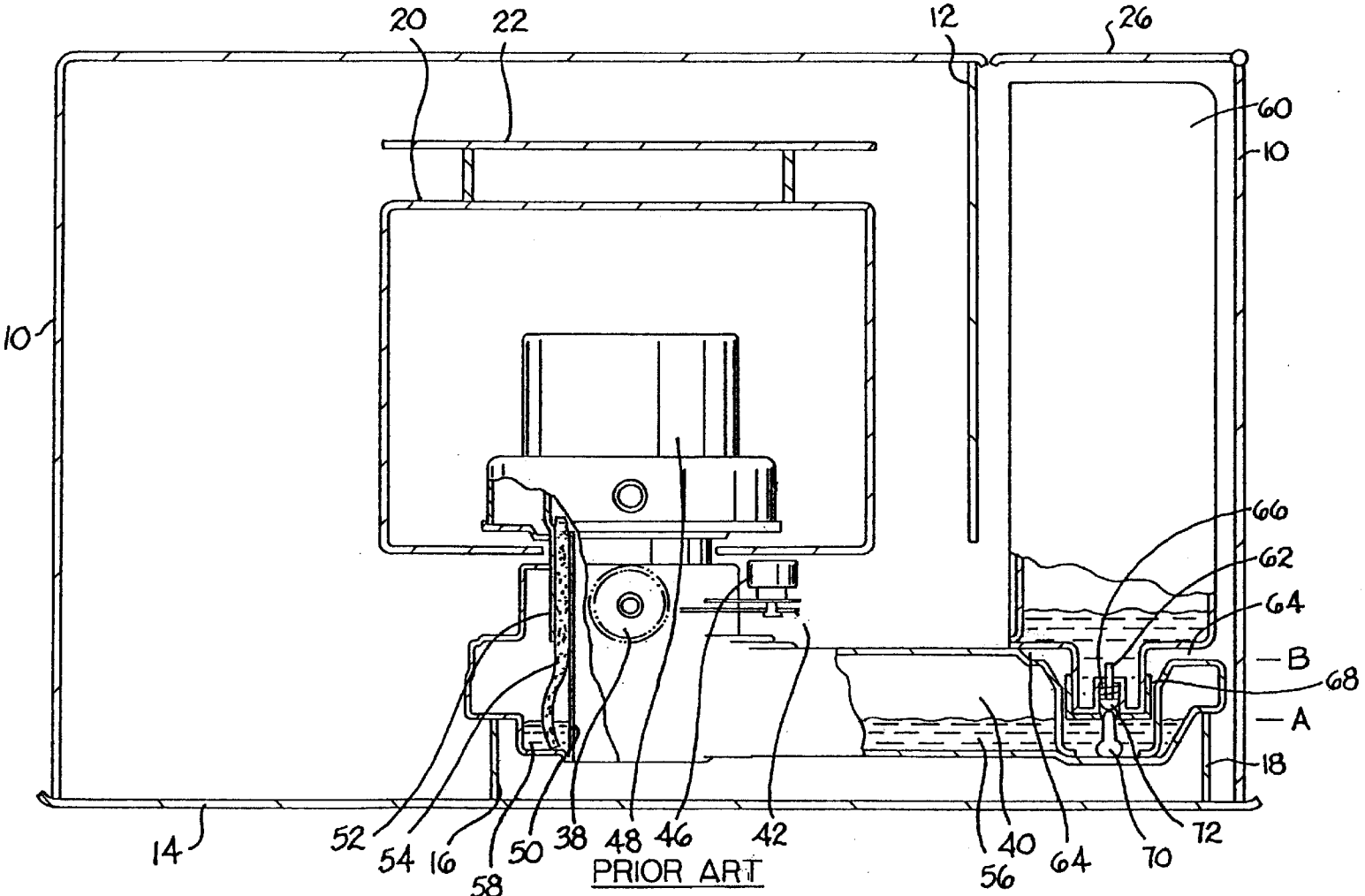
PRIOR ART FIG. 1
FIG. 1 is a side sectional view of a prior-art, wick-fed, barometric-type liquid fuel burner with a removable fuel tank, and an automatic wick extinguishing unit that can be actuated by a vibration-sensing weight.

10 Cabinet
12 Tank guide
14 Basetray
16 Support
18 Support
20 Reflector
22 Heat shield
24 Attached at
26 Lid
28 Fusible Link
30 Support
32 Attached at
34 Hinge
36 Attached at
38 Wick gear
40 Fuel chamber
42 Automatic wick extinguishing unit
44 Hinge
46 Vibration-sensing weight
48 Combustion cylinder assembly
50 Inner wick guide
52 Outer wick guide
54 Wick
56 Fuel
58 Wick fuel supply reservoir
60 Removable fuel tank
62 Plunger
64 Opening
66 Plunger spring
68 Tank cap
70 Pin
72 Plunger head
74 Arm
76 Attached at
78 Lever
80 Face
82 Support
A Normal fuel level
B Flooded fuel level

SUMMARY

In accordance with the present invention, an anti-flareup safety device for wick-fed, barometric liquid fuel burners irreversibly shuts off the burner when excessive temperature levels are reached near the removable fuel tank, thereby preventing the flooding of the fuel chamber and flareup. The safety device includes a fusible link mechanism that acts to shut off the burner when excessive temperature levels are reached at the removable tank. The system consists of a fusible link, an arm, and a lever with a face. When the temperature at the fusible link reaches a pre-determined level, the fusible link will open irreversibly, allowing the arm to move down. The movement of the arm causes the lever to move, and, concomitantly, the face. The movement of the face actuates the automatic wick extinguishing mechanism.

Description—Conventional Heater Structure—FIG. 1

FIG. 1 is a side sectional view of a conventional wick-fed barometric liquid-fuel burner (as described supra) that operates by burning a liquid fuel, such as kerosene. The burner is a wick-fed type with a combustion cylinder 48 and is constructed in a manner widely known in the art. One manufacturer of the burner of FIG. 1 is Toyotomi Company of Japan, and such manufacturer sells such burners under the trademark Kero-Sun.

In normal operation fuel is delivered from a removable fuel tank 60 to a horizontal fuel chamber 40 through an orifice in a tank cap 68 on tank 60. Tank 60 is held in a vertical position by tank guide 12 in cabinet 10 in accordance with the common practice of the industry. Cap 68, which is attached to the neck of tank 60, is inserted into a mating well, or sump, in the top surface of chamber 40, also the common practice in the industry. A lid 26 is located over removable fuel tank 60. Fuel chamber 40 and cabinet 10 are supported on a basetray 14. Fuel chamber 40 is attached to basetray 14 by supports 16 and 18.

When the fuel level in chamber 40 drops below level A due to fuel consumption by wick 54, air will bubble into tank 60 through orifice 74 in tank cap 68, and fuel (e.g., kerosene) will flow from tank 60 into chamber 40 until the level in chamber 40 reaches level A. A partial vacuum above the fuel in tank 60 maintains the fuel in tank 60 above level A until all of the fuel has been discharged from tank 60. Fuel 56, which is in fluid communication with wick 54, migrates by capillary action up wick 54 and is burned inside combustion cylinder assembly 48, which generally consists of two or three concentric inner metal cylinders and an outer glass cylinder, which is shown. The flame is not shown, but is seen as a red glow in cylinder assembly 48, above the wick. Heat from the flame is directed outward by reflector 20. Heat shield 22 reduces the temperature of the top of cabinet 10.

Wick 54, cylindrical in shape and shown in a partial cross-sectional view, can be moved up or down by rotating a wick gear 38. Wick 54, wick guides 50 and 52, combustion cylinder 48, wick fuel supply reservoir 58, and vibration-sensing weight 46 are circular in shape when seen from above, whereas compartment 40 is generally rectangular. Removable fuel tank 60 is most commonly rectangular in shape as viewed from above, but various other shapes are also found, such as triangular. Tank cap 68 is cylindrical in shape, and is threaded to allow attachment to tank 60. Tank cap 68 contains plunger 62 with plunger head 72, and plunger spring 66.

The fuel burner has an automatic wick extinguishing unit 42, which includes a vibration-sensing weight 46. If the burner is vibrated excessively, unit 42 disengages wick gear 38, which lowers wick 54, extinguishing the flame, or actuates any other wick extinguishing mechanism (not shown).

Operation and Danger of Flareup With Conventional Burner—FIG. 1

If the partial vacuum in tank 60 is lost, the barometric system of the burner of FIG. 1 no longer regulates fuel flow from tank 60. As stated, the partial vacuum may be lost by compromise of the integrity of tank 60, or by the presence of a high vapor pressure in tank 60, e.g., due to heating of tank 60. Most flareup incidents occur when a high-volatility fuel is inadvertently introduced into tank 60—most commonly, gasoline or gasoline-contaminated fuel. As a result, excessive fuel will flow into chamber 40. Since the capacity of tank 60 is about two liters (two quarts) greater than that of chamber 40, chamber 40 will not be able to contain all of the fuel from tank 60, if any significant amount of fuel is present in tank 60. As a result, fuel fills chamber 40 and when it reaches level B, overflows via opening 64 between tank 60 and the top of chamber 40.

The fuel spreads over the fuel chamber's surface and to other areas in the burner. The flooded fuel will ignite because the vapors from the leaked fuel are drawn by air movement toward the wick flame (not shown) in cylinder 48, which is of sufficient temperature to ignite these fumes. As a result, there will be flames in and around tank 60, causing the pressure inside tank 60 to increase dramatically, driving more fuel out of tank 60, which further increases the amount of escaped fuel, and accordingly increases the severity of the flareup. If not immediately extinguished, e.g., by a human operating a $CO_2$ or other fire extinguisher designed for oil-based fires, such a flare-up will usually cause great property damage and/or severe human injury or loss of life. In addition, the manufacturers and resellers of these devices will face expensive lawsuits due to such damage.

The flareup incidents involving high-volatility fuels do not occur immediately after the burners are lit, but usually after an induction period of one or more hours. There is a delay because these burners are utilized for heating purposes at cooler ambient temperatures. At such temperatures, even the high-volatility fuels have vapor pressures low enough that the partial vacuum above the liquid in tank 60 is adequate to maintain the column of fuel in the tank, which requires a pressure differential of only approximately 3 kiloPascals (kPa), or 0.4 pound per square inch (psi), for the 36 cm (14 in) height typical of removable tanks.

For example, at 27° C. (80° F.) the vapor pressure of the most volatile class of gasoline, Class E, is on the order of 69 kPa (10 psi). Since ambient pressure is around 101 kPa (14.7 psi), a column of gasoline nearly 5 m (15 ft) high could be maintained at such a pressure differential. However, should the temperature of the gasoline reach 38° C. (100° F.)—the approximate boiling point of gasoline—its vapor pressure will increase to about 101 kPa (14.7 psi), and the fuel will flow out of the removable tank and into the fuel chamber in an uncontrolled manner. This will circumvent the normal operation of the barometric valve. The increase in temperature of the air space in the removable tank during operation of the burner is not a significant factor in the loss of the partial vacuum in the removable tank. This is because the temperature increases are not rapid enough to overcome the normal action of the barometric valve in controlling fuel flow from tank 60 as fuel is consumed by the wick.

Unless the burner is in a very low temperature environment, the temperature of the removable tank will typically exceed 38° C. (100° F.) during operation of the burner. The removable tank achieves such temperatures due to its proximity. about 13 cm (5 in), to the combustion process, which reaches temperatures in excess of 850° C. (1600° F.).

During operation of the burner, heat is transferred by radiation, convection, and conduction processes from the combustion cylinder to the removable tank.

The typical flareup scenario in such burners is as follows: Initially, the fuel in the removable tank is at a low enough temperature so that its vapor pressure is insufficient to allow liquid to flow from the removable tank beyond that allowed by the barometric valve. At this point, the liquid level in the fuel chamber will be maintained at the level of the barometric valve, which allows fuel to flow from the removable tank into the fuel chamber only as fuel is consumed by the wick. The temperature of the removable tank, as well as the fuel inside it, increases as the temperature of the burner rises, causing the vapor pressure of the fuel to increase. Then the increased vapor pressure of the fuel compromises the partial vacuum inside the removable tank, allowing fuel in the removable tank to flow into the fuel chamber in an uncontrolled manner. Since the capacity of the removable tank (4–5 liters) far exceeds that of the fuel chamber (1–2 liters), the fuel chamber fills and overflows. The vapors from the spilled fuel ignite and flareup ensues.

With the exception of the above Henderson and Lightsey device (U.S. Pat. No. 5,338,185), the above Henderson tank-lift, pin drop, thermal barrier/fuel containment, vapor containment/tank-block, float/fuel shutoff and sump vapor containment, and tank fuel flow regulation devices (U.S. Pat. Nos. 5,456,595, 5,409,370, 5,549,470, 5,662,468, 5,730,115, 5,772,425, and 5,899,682, respectively), the above Henderson and Henderson device (U.S. Pat. No. 5,551,865), and the above Henderson and Lucas device (U.S. Pat. No. 5,967,765), prior-art safety devices do not prevent flareup, but rather detect evidence that flareup has begun, and then trigger an automatic wick extinguishing unit, which acts to extinguish the flame on the wick. However, by the time flareup has begun, flames are outside the wick area, and extinguishment of the wick flame does not affect the progression of flareup. The flames are present where fuel has flooded, and the increasing amounts of fuel being discharged from the removable tank further increase the magnitude of the flareup incident, as described earlier.

The Henderson and Lightsey device (U.S. Pat. No. 5,338,185) is designed to extinguish the flame on the wick prior to flareup. However, if the wick shutoff mechanism fails to operate when activated as a result of the wick or its mechanism becoming encrusted, this device may not be able to prevent flareup. The Henderson tank-lift and pin-drop devices (U.S. Pat. Nos. 5,456,595 and 5,409,370, respectively) are designed to shut off fuel flow from the removable tank to the fuel chamber by separating the removable tank from the pin that opens the barometric device in the cap on the removable tank cap. However, these two devices have one feature in common: should they not operate properly to stop fuel flow from the removable tank, excess fuel may enter the fuel chamber.

The Henderson thermal barrier/fuel containment device (U.S. Pat. No. 5,549,470) is very simple and effective; however, fuel vapors in the vicinity of the removable tank may migrate over the walls of the fuel containment sump, which surrounds the removable tank, and may be drawn to the wick flame by the air movement in the burner, where they may be ignited. Also, the added components will increase the weight of the burner. The Henderson vapor containment/tank block mechanism (U.S. Pat. No. 5,662,468) is quite simple and effective. However, in order to contain an amount of fuel equal to the full capacity of the removable tank, this device requires either a) the incorporation of two additional compartments (beyond the fuel chamber), or b) the incorporation of one additional compartment, and an increase in the capacity of the fuel chamber. The Henderson sump vapor containment device (U.S. Pat. No. 5,772,425) acts to contain vapors in the sump area. However, this device does not prevent excess fuel from entering the fuel chamber. The Henderson and Henderson tank fuel flow regulation device (U.S. Pat. No. 5,899,682) restricts the rate at which fuel leaves the removable tank. However, the fuel flow varies with depth of the fuel.

The Henderson and Lucas tank fuel regulating device (U.S. Pat. No. 5,967,765) causes fuel flow from the removable fuel tank to be constant. Should the device fail to regulate the fuel flow, excess fuel may enter the fuel chamber.

The Henderson and Henderson thermocouple/solenoid device (U.S. Pat. No. 5,551,865) provides a self-test of the system each time the burner is operated. However, it requires incorporation of electrical circuits and components, and depends upon the proper functioning of the automatic wick shutoff mechanism. The Henderson float/fuel shutoff device is designed to block fuel flow into the fuel chamber when excess fuel is lost from the removable tank. Should the float not respond, or if the opening for fuel flow does not close properly, excess fuel may enter the fuel chamber.

Thus, prior-art safety devices, such as those which monitor excessive vibration of the burner, which detect high levels of $CO_2$ and low levels of $O_2$, which detect abnormal combustion, and which regulate the position of the wick to prevent excessive flaming, are ineffective in preventing flareup. The safety device described in the Josephs patent, supra, does not prevent flareup, but rather provides a wick-drop mechanism, and cuts off fuel flow through a fuel line after the onset of flareup. Since the wick-fed barometric liquid fuel burners in common use do not utilize a fuel line, Josephs' device is not applicable to them.

The Henderson and Lightsey, and the Henderson tank-lift, pin-drop, and float/fuel shutoff devices (U.S. Pat. Nos. 5,338,185, 5,456,595, 5,409,370, and 5,730,115, respectively) are designed to prevent flareup, but should they not operate properly, flooding of the fuel chamber may occur, and flareup may result. In the case of the Henderson thermal barrier/fuel containment device (U.S. Pat. No. 5,549,470), the additional components will increase the weight of the burner. To be most effective, the Henderson vapor containment/tank block device (U.S. Pat. No. 5,662,468) requires either the incorporation of two separate compartments as an adjunct to the fuel chamber, or an increase in the capacity of the fuel chamber and incorporation of one additional compartment. The Henderson vapor containment device (U.S. Pat. No. 5,662,468) may not prevent flareup should excess fuel enter the fuel chamber. The Henderson and Henderson removable tank fuel flow regulation device (U.S. Pat. No. 5,899,682) does not maintain a constant flow of fuel from the removable tank. The Henderson and Henderson thermocouple/solenoid device (U.S. Pat. No. 5,551,865) is designed to actuate the wick shutoff mechanism. However, should that mechanism fail to respond, flareup may result. The Henderson and Lucas tank fuel regulating device (U.S. Pat. No. 5,967,765) controls the rate at which fuel leaves the removable tank. If the device fails to regulate the flow rate, flareup may occur.

Thus while many types of safety devices are known, these devices have not yet been fully incorporated in liquid fuel burners; accordingly, flareups and fires continue to occur, causing loss of life, injury, and property damage.

Figure 2:
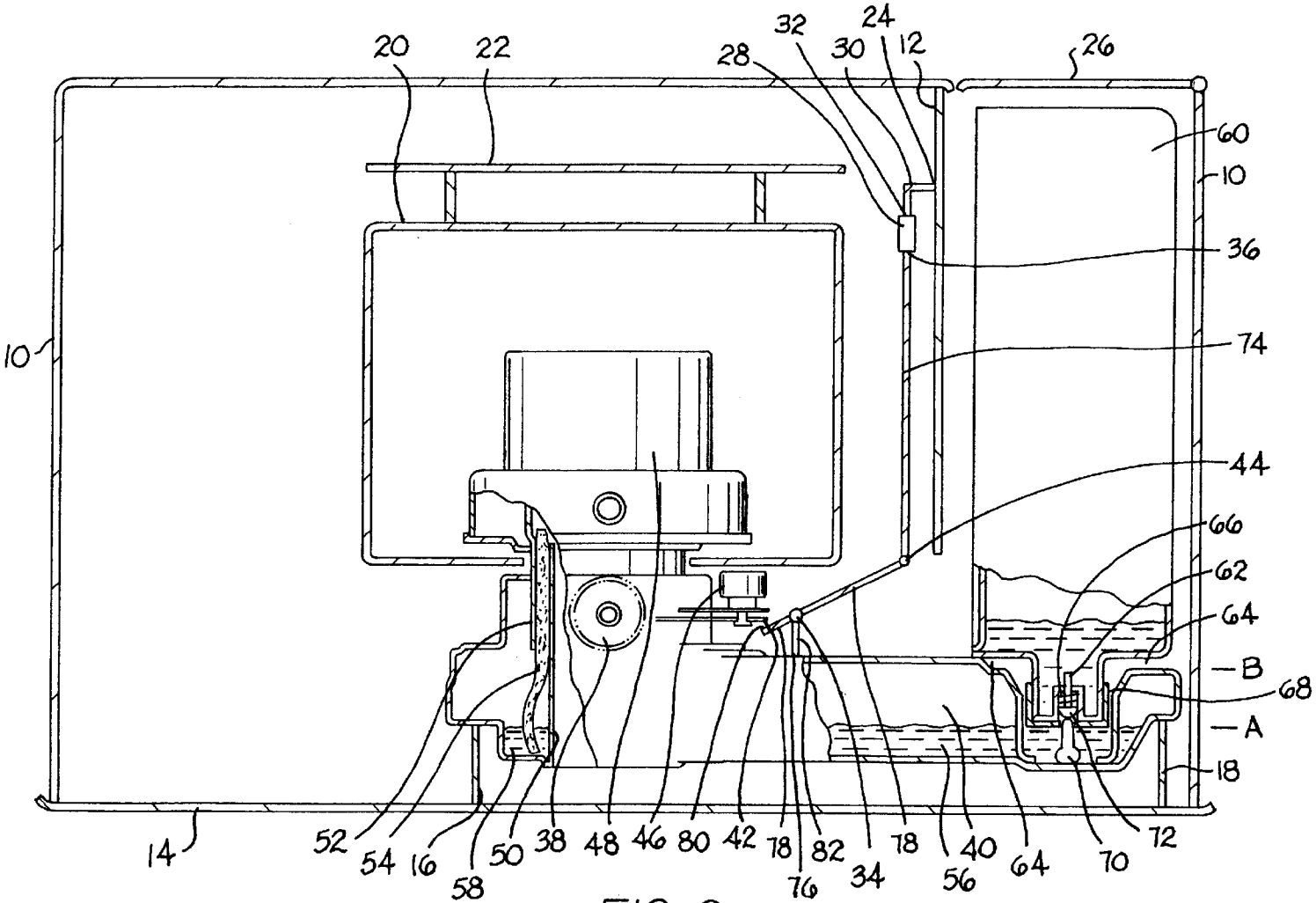
FIG. 2 is a side sectional view of a liquid fuel burner with an anti-flareup safety device in accordance with the preferred embodiment of the present invention.

Description of Inventive Anti-Flareup Device—FIG. 2

A different approach from the earlier anti-flareup devices which overcomes the problem of loss of excess fuel from the removable tank due to high-volatility fuels, and thereby reduces the likelihood of flareups and fires, is illustrated in FIG. 2. which shows a barometric-type liquid fuel burner with the present inventive addition. The device operates by providing a system that actuates the wick extinguishing mechanism when the temperature in the vicinity of the removable fuel tank reaches excessive levels. The device of FIG. 2 includes the conventional elements illustrated in FIG. 1. In the typical fashion, as tank 60 is lowered into cabinet 10, pin 70 contacts plunger head 72, forcing it backward into cap 68, which allows fuel in tank 60 to flow into fuel chamber 40.

In addition, it includes additional elements which constitute a preferred embodiment of the present inventive anti-flareup safety device. A fusible link 28 (such as is commonly used in heating devices and commercial kitchen fire extinguishing equipment) is attached at 32 to support 30, which in turn is attached at 24, to tank guide 12. At its distal end from support 30, fusible link 28 is attached at 36 to arm 74. The other end of arm 74 is attached to lever 78 by a hinge 44. Lever 78 is supported by support 82, to which it is attached by hinge 34. Support 82 is attached at 76 to the upper surface of fuel chamber 40. Lever 78 has a face 80 located on the left side of lever 78, distal from arm 74.

Fusible link 28 is approximately 4 cm long, 2 cm wide, and 0.5 cm thick. Such fusible links, which are manufactured by Brooks Equipment Company of Charlotte, N.C. and other companies, typically consist of two pieces of metal (commonly steel or brass) joined by a solder, which melts at a lower temperature than the two pieces of metal, and is selected on the basis of its melting point. A solder with a melting point of about 66° C. (150° F.) is preferable for the design illustrated in FIG. 2. Arm 74 is about 20 cm long, 1 cm wide, and 0.4 cm thick. Lever 78 is about 10 cm long, 1 cm wide, and 0.4 cm thick. Support 30 is approximately 2 cm long, 1 cm wide and 0.4 cm thick. Support 82 is around 5 cm long, 1 cm wide and 0.4 cm thick. Arm 74, lever 78, support 82 and hinges 34 and 44, are all preferably metal. Hinges 34 and 44 are about 1 cm wide and 0.2 cm thick, with an overall length of 2 cm. Face 80 can be made by bending the end of lever 78 upward, or it can be a separate entity attached to the end of lever 78 closest to the wick extinguishing mechanism.

Operation of Inventive Anti-Flareup Device—FIG. 2

After operation of the burner for a period of time, tank 60 will become depleted of fuel, and the wick flame (not shown) will extinguish. Should further operation of the burner be desired, it is necessary that tank 60 be refueled. The refueling procedure consists of removing tank 60 from the burner, inverting the tank, removing cap 68, and introducing fuel into tank 60. When the fueling process is completed, cap 68 is replaced on tank 60, which is inverted and inserted into the burner in the usual fashion.

After the wick is ignited, the temperature of fusible link 28 will increase to its normal operating temperature. However, should the temperature at fusible link 28 become excessive, i.e., over its melting temperature of 66° C. (150° F.), fusible link 28 will open irreversibly, allowing the weight of arm 74 to move the arm downward. As a result, lever 78 will move, causing face 80 to actuate wick extinguishing unit 42. This will cause the wick to be withdrawn, shutting off the burner and preventing a flareup.

Advantages

It is clear from the discussion above that the anti-flareup safety device is quite simple in construction, and can be readily incorporated in wick-fed barometric liquid fuel burners without affecting the remainder of the burner. Yet it will prevent flareup by providing a system that actuates the wick extinguishing mechanism in a non-reversible fashion should the temperature reach excessive levels in the vicinity of the removable tank.

The present device prevents the burning of fuel outside its intended site, that being at the wick, thereby saving fuel and reducing smoke and odor. Also, the device does not require any electrical power or electronic circuitry for the prevention of flareup. The device is quite simple, and it can readily be incorporated in contemporary burners.

Clearly, the device will make barometric-type liquid fuel burners safer to operate, and accordingly, will at the same time reduce the incidence of injury, loss of life, and property damage, and will also reduce the expensive lawsuits resulting from flareup incidents. As a result these burners will be easier to market.

RAMIFICATIONS AND SCOPE

Those skilled in the art can now appreciate from the foregoing description that the broad teachings of the present invention can be implemented in a variety of forms. Therefore, while the safety device has been described in connection with particular examples thereof, the true scope of the invention should not be so limited since other modifications will become apparent to the skilled practitioner upon a study of the drawings. specification, and following claims.

For example, the shape and composition of the safety device can be varied, so long as its function is preserved. Fusible link 28, arm 74, lever 78, face 60, and support 82 may have various cross-sectional shapes, such as square, rectangular, oval or other convenient shapes, and their locations may be changed, so long as their functions are preserved. For example, a spring could be utilized to urge movement of lever 78 in its actuation of automatic wick extinguishing unit 42.

Additionally, the device may be connected to or used in combination with other safety devices, such as fuel containment features, or warning gauges. Thus the scope of the invention should be determined, not by the examples given, but by the appended claims and their legal equivalents.

What is claimed is:

1. An apparatus for preventing flareup in a liquid fuel burner of the type comprising (a) a removable tank for holding liquid fuel, (b) a tank guide for holding said removable tank, (c) a fuel chamber for receiving said fuel from said tank, (d) a sump opening in said fuel chamber where said fuel in said tank is transferred to said fuel chamber, and (e) a combustion chamber having a wick, where said fuel chamber supplies said liquid fuel from said removable tank to said wick of said combustion chamber, comprising:

heat-sensitive member for detecting temperature levels in the vicinity of said removable tank, said-heat-sensitive member responding by an irreversible physical change to a temperature over a predetermined value; and an automatic wick extinguishing means for extinguishing the flame on said wick in response to said irreversible physical change of said heat-sensitive member, said heat-sensitive member being affixed to said tank guide.

2. The apparatus of claim 1 wherein said heat-sensitive member has two ends, and further including an arm, one end of said heat-sensitive member being affixed to said tank guide, the other end of said heat-sensitive member being connected to said arm.

3. The apparatus of claim 2, further including a lever, said lever being connected to said arm.

4. The apparatus of claim 3 wherein said lever has a face and two ends, said face being located at the end of said lever distal from the connection of said lever to said arm.

5. An apparatus according to claim 4 wherein said face is in contact with said automatic wick extinguishing unit.

6. A method of preventing flare-up in a liquid fuel burner of the type comprising a removable tank for holding liquid fuel, a tank guide for holding said removable tank, a fuel chamber, a sump in said fuel chamber where said liquid fuel in said removable tank is transferred to said fuel chamber, a combustion chamber having a wick, and an automatic wick extinguishing unit, where said fuel chamber carries said liquid fuel from said removable tank to said wick of said combustion chamber, comprising:

providing a heat-sensitive member for detecting the temperature level in the vicinity of said removable tank, said heat-sensitive member responding by an irreversible physical change to a temperature over a predetermined value; and positioning said heat-sensitive member so that it actuates said automatic wick extinguishing unit in response to said irreversible physical change of said heat-sensitive member, said heat-sensitive member having two ends and further including an arm, one end of said heat-sensitive member being affixed to said tank guide, the other end of said heat-sensitive member being connected to said arm.

7. The method of claim 6, further including a lever, said lever being connected to said arm.

8. The apparatus of claim 7 wherein said lever has a face and two ends, said face being located at the end of said lever distal from the connection of said lever to said arm.

9. An apparatus according to claim 8 wherein said face is in contact with said automatic wick extinguishing unit.

10. The method of claim 6 wherein said heat-sensitive member comprises a fusible link, said fusible link comprising a bimetallic strip comprising two different metal layers with a low-melting material joining said metal layers, said fusible link being affixed to said tank guide.

* * * * *